US006976878B2

(12) United States Patent
Shindo

(10) Patent No.: US 6,976,878 B2
(45) Date of Patent: Dec. 20, 2005

(54) ELECTRICAL CONNECTING DEVICE

(75) Inventor: Satoru Shindo, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/946,676

(22) Filed: Sep. 22, 2004

(65) Prior Publication Data

US 2005/0064763 A1 Mar. 24, 2005

(30) Foreign Application Priority Data

Sep. 22, 2003 (JP) ..... 2003-329484

(51) Int. Cl.[7] ..... H01R 13/66
(52) U.S. Cl. ..... 439/620
(58) Field of Search ..... 439/620, 694; 333/185, 206

(56) References Cited

U.S. PATENT DOCUMENTS

| | | | | |
|---|---|---|---|---|
| 6,152,775 | A * | 11/2000 | Pavlovic | 439/620 |
| 6,217,388 | B1 | 4/2001 | Francis | |
| 6,461,184 | B2 * | 10/2002 | Nimura | 439/352 |
| 6,743,051 | B2 * | 6/2004 | Hayashi | 439/620 |
| 6,799,999 | B2 * | 10/2004 | Williamson et al. | 439/676 |
| 6,837,732 | B2 * | 1/2005 | Pavlovic et al. | 439/352 |

FOREIGN PATENT DOCUMENTS

| | | |
|---|---|---|
| EP | 1 150 389 A1 | 10/2001 |
| WO | WO-00/04609 | 1/2000 |

OTHER PUBLICATIONS

European Search Report dates Nov. 28, 2004, 2 pages.
European Search Report dated Aug. 27, 2001, 2 pages.
International Search report dated Sep. 28, 1999, 3 pages.

* cited by examiner

*Primary Examiner*—Gary Paumen
(74) *Attorney, Agent, or Firm*—Osha Liang LLP

(57) ABSTRACT

A male connector component 12 has a container part 20 holding a pair of connecting terminals 11, 11 and a ferrite member 14, and a lock part 24 which has a tapered part 24*a* protruding toward the inside of the container part 20 and in which the tapered part 24*a* is engaged with a shoulder 14*c* of the ferrite member 14. The male connector component 12 is fittably inserted into an opening 3 formed in a female connector component 2. A cover element 13 is fitted to the male connector component 12 in such a way as to cover the upper opening of the container part 20 and as to sandwich the connecting terminals 11 and the ferrite member 14 between the cover element 13 and the male connector component 12. The cover element 13 regulates the movement of the lock part 24 in a direction in which the engagement between the lock part 24 and shoulder 14*c* is released.

4 Claims, 13 Drawing Sheets

ELECTRICAL CONNECTING DEVICE

TECHNICAL FIELD

The present invention relates to an electrical connecting device that has a male connector component, which holds a pair of connecting terminals and a ferrite member, and a cover element fitted to the male connector component and that is connected to a female connector component supporting a pair of to-be-connected terminals.

BACKGROUND ART

A device disclosed in Japanese Unexamined Patent Application Publication No. 2002-33153 is conventionally known as an electrical connecting device that has a male connector component, which holds a pair of connecting terminals and a ferrite member, and a cover element fitted to the male connector component and that is connected to a female connector component supporting a pair of to-be-connected terminals. The electrical connecting device disclosed in this publication (No. 2002-33153) is a plug connector that is connected to a socket connector so as to realize an ignition circuit of a detonator of an air bag gas generator for vehicles. This electrical connecting device is made up of a connector housing (male connector component), a connector cover (cover element), a pair of electric contacts (a pair of connecting terminals), and a ferrite part (ferrite member) used as a means for absorbing electromagnetic wave noise. The electrical connecting device is designed so that the connector cover is fitted to the connector housing so as to form a unit as a plug connector in a state in which the electric contact and the ferrite part are contained in an internal cavity (container part) of the connector housing. The ferrite part contained in the internal cavity has a pair of projections, and the pair of projections are engaged with a pair of clips that protrude toward the internal cavity when the ferrite part is contained in the internal cavity. Accordingly, the ferrite part is held in the internal cavity. The plug connector formed as a unit is fittably inserted into a socket cavity (opening) formed in the socket connector (female connector component), and is electrically and mechanically connected to the socket connector.

In the electrical connecting device disclosed in the aforementioned publication (No. 2002-33153), the ferrite part is held by engaging the projection of the ferrite part with the clip of the internal cavity with respect to the internal cavity of the connector housing. However, there is the possibility that a slight gap will occur between the projection of the ferrite part and the clip of the internal cavity, depending on a variation in the size of the ferrite part. If so, the ferrite part will become shaky in the internal cavity so as not to be stably supported, and, disadvantageously, the noise removing performance is liable to be lowered.

DISCLOSURE OF THE INVENTION

It is an object of the present invention to provide an electrical connecting device capable of preventing the ferrite member from becoming shaky owing to a variation in the size of the ferrite member and capable of stably holding the ferrite member in the container part.

In order to achieve the object, the electrical connecting device according to the present invention is characterized in that the electrical connecting device is connected to a female connector component supporting a pair of to-be-connected terminals, and the electrical connecting device comprises a ferrite member having a pair of through-holes through which a pair of connecting terminals that are electrically connected to the pair of to-be-connected terminals are respectively passed; a container part that holds the pair of connecting terminals and the ferrite member; a male connector component that is fittably inserted into an opening formed in the female connector component, the male connector component having a lock part, the lock part having a tapered part protruding toward the inside of the container part, the tapered part being engaged with a shoulder of the ferrite member contained in the container part; and a cover element that is fitted to the male connector component in such a way as to sandwich the connecting terminals and the ferrite member between the cover element and the male connector component while covering an upper opening of the container part into which the connecting terminals and the ferrite member are inserted, the cover element regulating a movement of the lock part in a direction in which an engagement between the lock part and the shoulder is released.

According to this structure, the lock part of the male connector component is engaged with the shoulder of the ferrite member contained in the container part at its tapered part, and the movement of the lock part in a direction in which the engagement between the lock part and the shoulder is released is regulated by fitting the cover element to the male connector component. Therefore, even if the ferrite member varies in size, the shoulder of the ferrite member is held while being pressed toward the inside of the container part by means of the tapered part, and a variation in size can be absorbed. Therefore, the ferrite member can be prevented from becoming shaky, and can be stably held in the container part.

The aforementioned object, other objects, features, and advantages of the present invention will become apparent from reading the following description with reference to the attached drawings.

BEST MODE FOR CARRYING OUT THE INVENTION

With reference to the attached drawings, a description will be hereinafter given of a best mode for carrying out the invention. The present invention is suitable to be applied as an electrical connecting device for a squib that is ignited by applying an electric current to a gas generator in a vehicular air bag system. Although an embodiment in this case will be described, the present invention can be widely and variously applied and can be applied in many different environments and for various kinds of objects.

Figure 1:
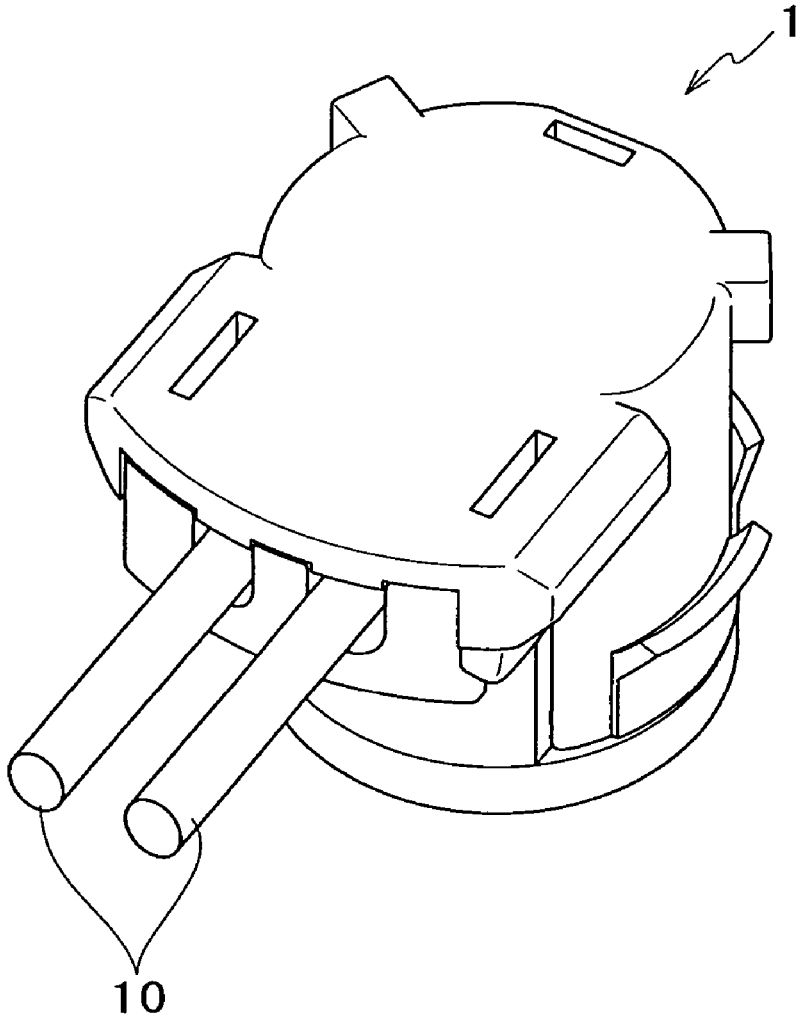
FIG. 1 is a perspective view depicting an electrical connecting device according to an embodiment of the present invention.
Figure 2:
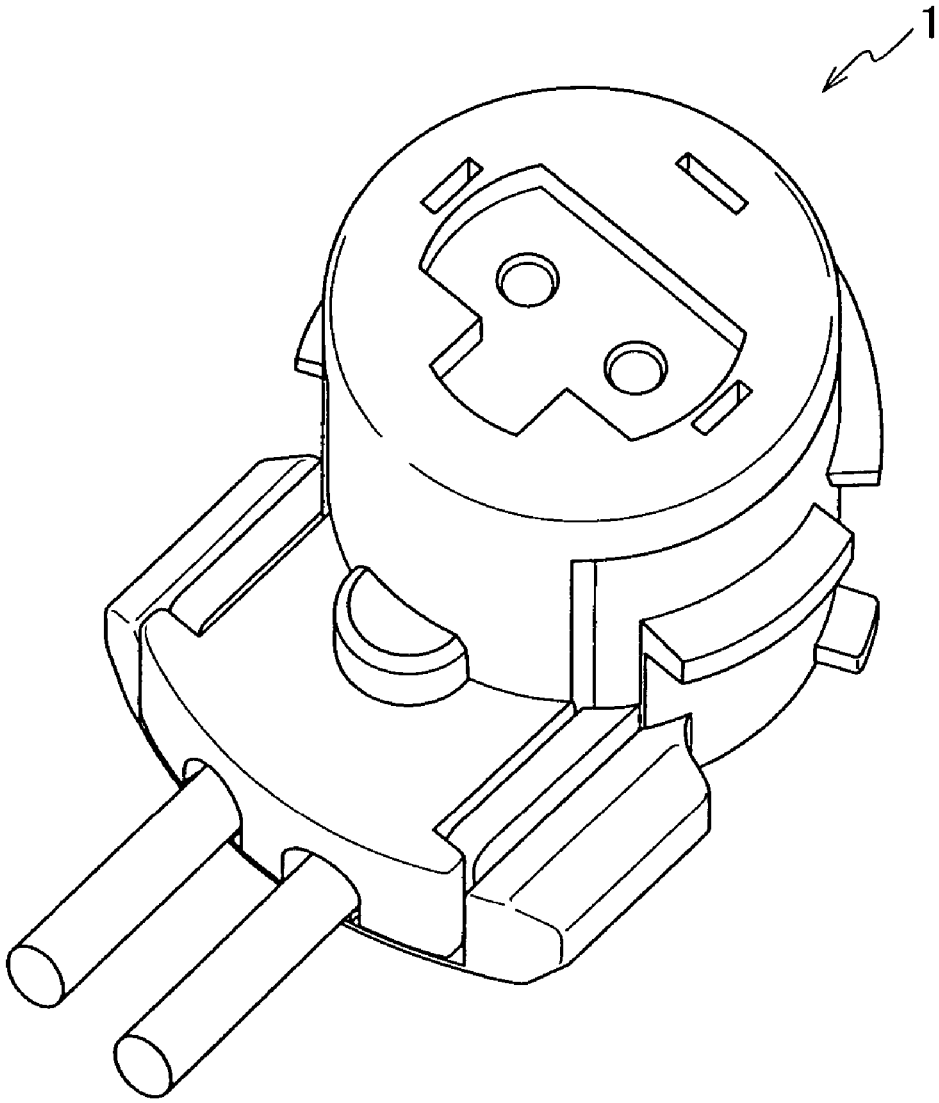
FIG. 2 is a perspective view of the electrical connecting device turned upside down from the state of FIG. 1.
Figure 3:
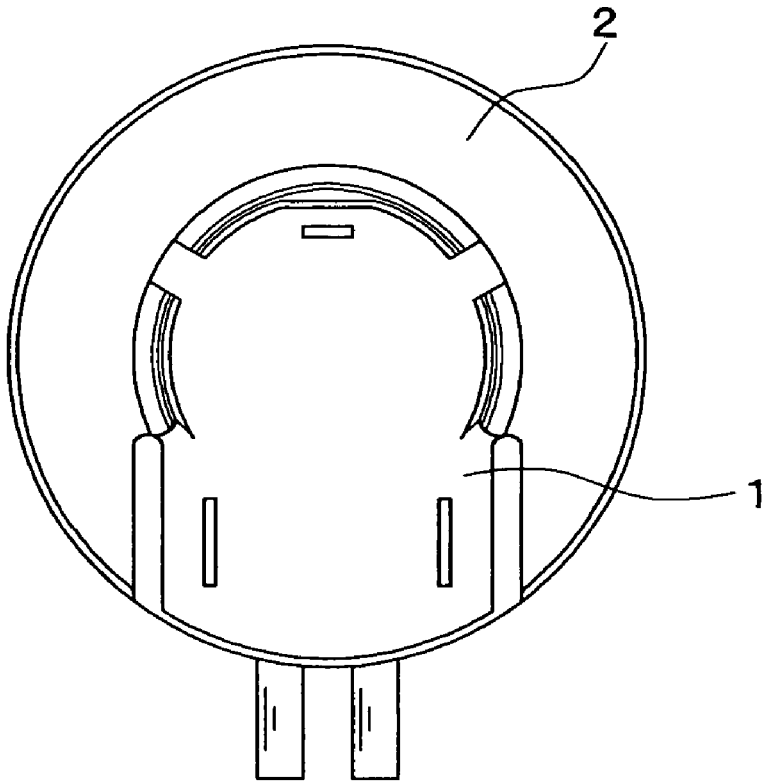
FIG. 3 is a plan view showing a state in which the electrical connecting device of FIG. 1 has been fitted and connected to a female connector component.

FIG. 1 is a perspective view of an electrical connecting device 1, seen from above, according to an embodiment of the present invention, and FIG. 2 is a perspective view of the electrical connecting device 1 turned upside down from the state of FIG. 1 (i.e., with a bottom of the electrical connecting device 1 up). FIG. 3 is a plan view showing a state in which the electrical connecting device 1 is fitted and connected to a connector component 2 to be connected (hereinafter, referred to as "female connector component 2"), and FIG. 4 is an exploded perspective view of the electrical connecting device 1.

As shown in FIG. 1 to FIG. 4, the electrical connecting device 1 is structured in the form of a plug that is connected to the female connector component 2 structured in the form of a socket. Lead wires 10 and 10 have their ends connected to a pair of connecting terminals 11 and 11, respectively, that are supported in the electrical connecting device 1. The other end of each of the lead wires 10 and 10 is connected to an air bag control system not shown. The female connector component 2 is provided as a part of an air bag igniting device (squib) not shown. The electrical connecting device 1 and the female connector component 2 are mechanically and electrically connected together by fitting the electrical connecting device 1 to the female connector component 2. That is, the electrical connecting device 1 and the female connector component 2 are engaged with each other, and the pair of connecting terminals 11 and 11 are brought into contact with a pair of to-be-connected terminals, respectively, that are supported by the female connector component 2. In a state in which the electrical connecting device 1 is in contact with the female connector component 2, the squib is burned by being supplied with sufficient electrical energy through the lead wires 10 and 10 in accordance with a command issued from the air bag control system. Gas generating materials are ignited by this burning, and an air bag is inflated.

Figure 13:
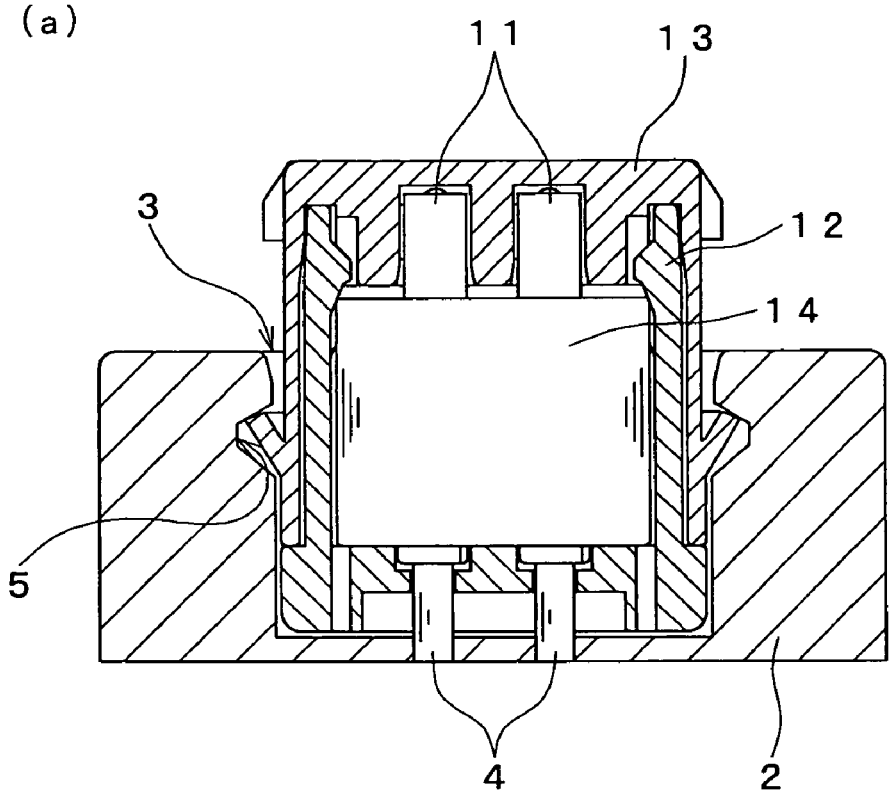
FIG. 13 is a sectional view showing a state in which the electrical connecting device has been connected to a VDA-LT type female connector component, and is a plan view of the female connector component thereof.
Figure 13:
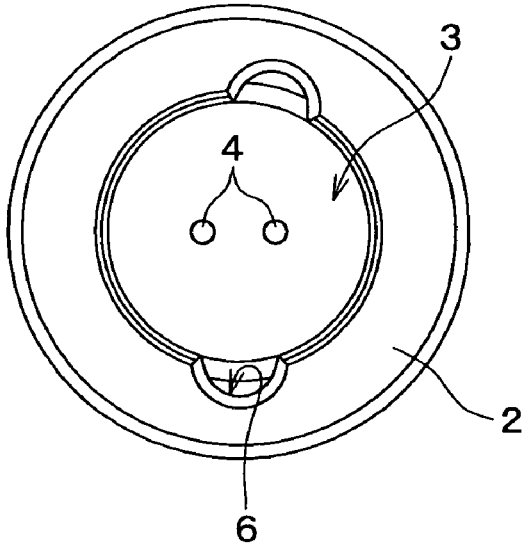

The shape of the female connector component 2 is determined according to a standard. FIG. 13 shows the female connector component 2 shaped according to a standard called a VDA-LT type, in which (a) is a sectional view showing a state in which the electrical connecting device 1 is connected to the female connector component 2, and (b) is a plan view of the female connector component 2. The female connector component 2 has an opening 3 to which the electrical connecting device 1 is fitted (in other words, an opening 3 for receiving the electrical connecting device 1). A pair of to-be-connected terminals (pins) 4 and 4, to which the pair of connecting terminals 11 and 11 are respectively connected, are supported in the opening 3. The shape of the opening 3 varies according to standards.

Figure 4:
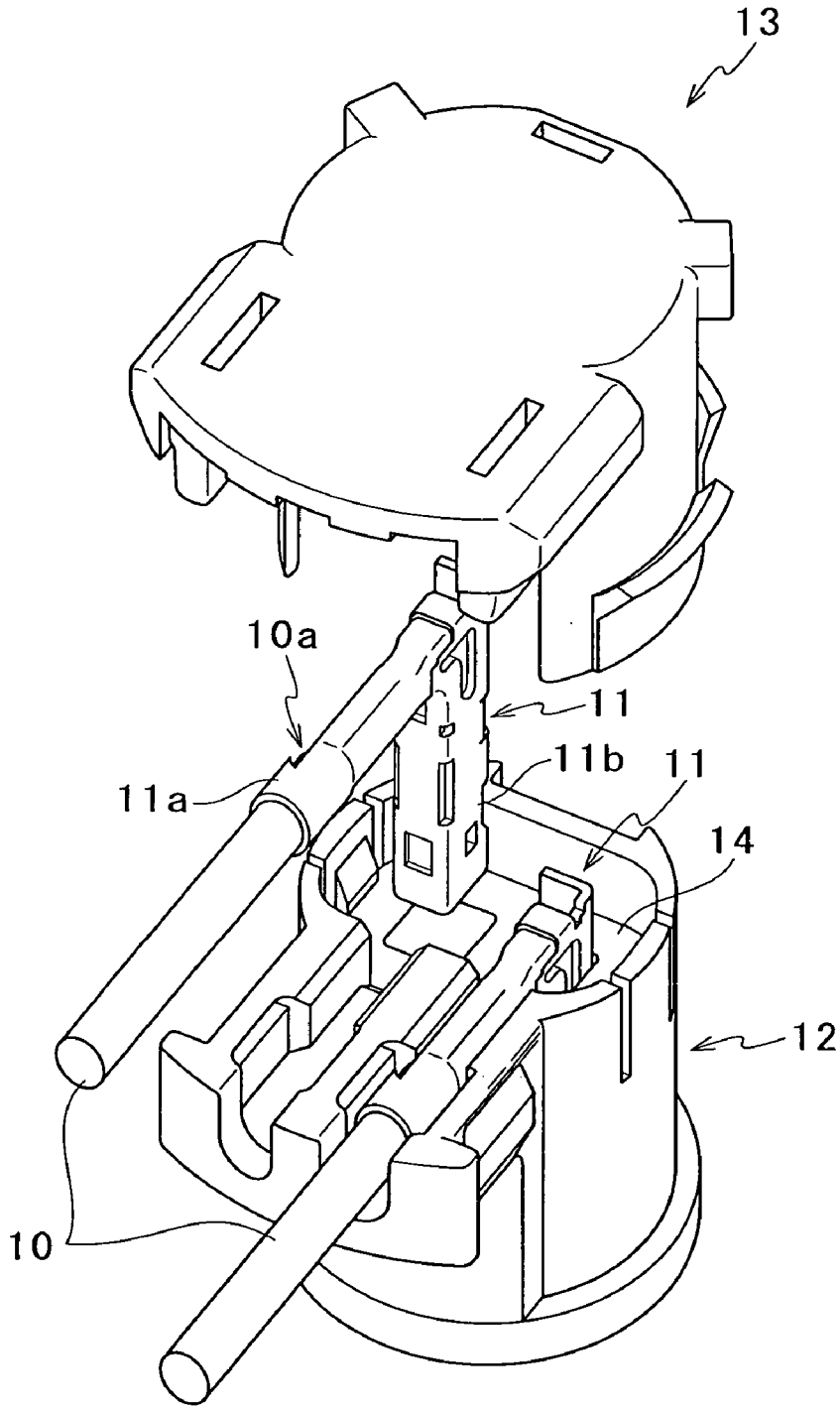
FIG. 4 is an exploded perspective view of the electrical connecting device of FIG. 1.

In FIG. 4, the electrical connecting device 1 includes the pair of connecting terminals 11 and 11, a connector component for connections (plug housing) 12, a cover element (cover housing) 13, and a ferrite member 14. The pair of connecting terminals 11 and 11 are each shaped substantially like the capital letter L, and a lead-wire-side end 11*a* of the connecting terminal 11 is pressed and attached to a naked end part 10*a* provided at an end of a coated lead wire 10. On the other hand, a connection-side end 11*b* of the connecting terminal 11 is inserted into the ferrite member 14, and is connected to the to-be-connected terminal 4 supported by the female connector component 2 by connecting the electrical connecting device 1 to the female connector component 2.

Figure 5:
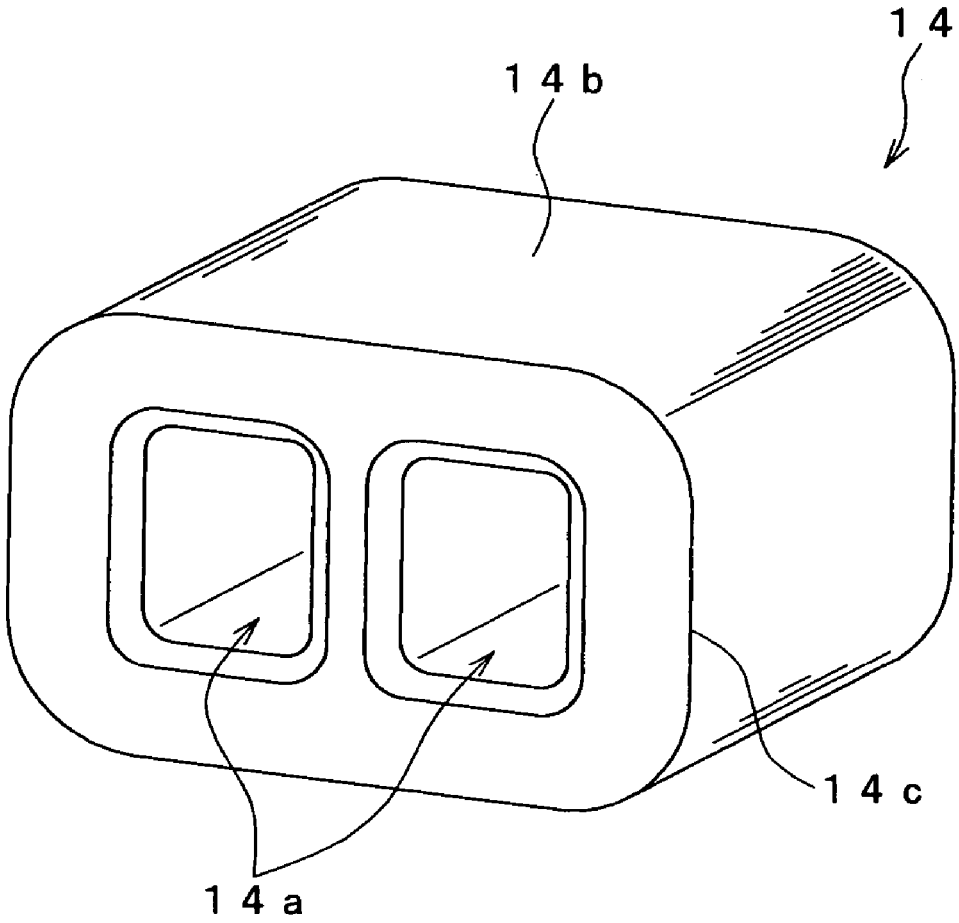
FIG. 5 is a perspective view of a ferrite member in the electrical connecting device of FIG. 4.

The ferrite member 14 is a member that is incorporated into the electrical connecting device 1 as a means for removing electromagnetic wave noise. In an air bag system constructed in a vehicle, a noise-removing function of the ferrite member 14 can prevent a noise current from flowing to a squib and causing an accidental explosion because of various electromagnetic waves emitted from outside electric wires, from various electronic devices in a car, from radios, or from cellular telephones. FIG. 5 is a perspective view of this ferrite member 14 placed sideways. The ferrite member 14 has a pair of through-holes 14*a* into which the connection-side ends 11*b* of the pair of connecting terminals 11 are respectively inserted. The ferrite member 14 additionally has a part 14*b* (hereinafter, referred to as "planar part 14*b*") planarly formed on a side face of its periphery. The planar parts 14*b* and 14*b* (only one of which is shown in the figure) form side faces, respectively, on the long side.

Figure 6:
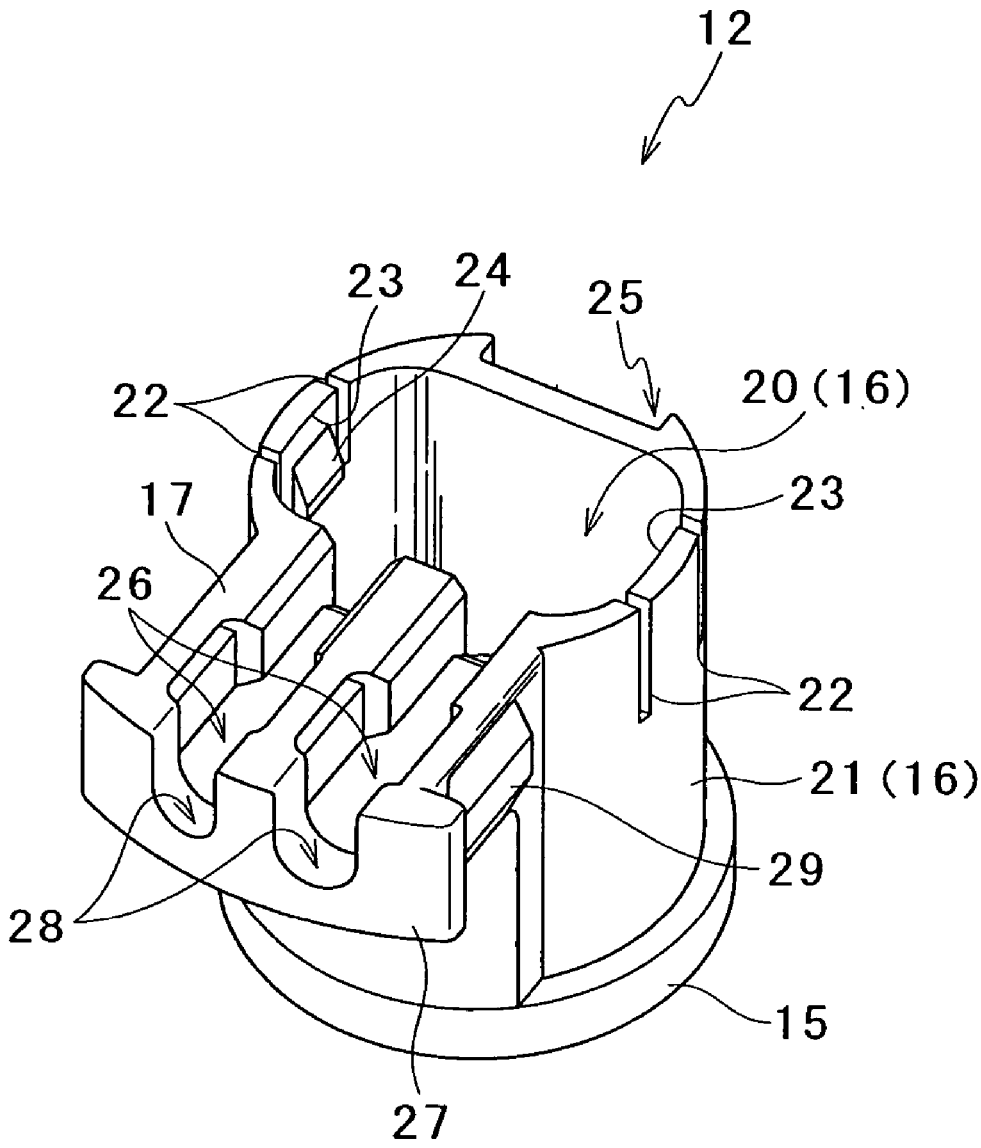
FIG. 6 is a perspective view of a male connector component in the electrical connecting device of FIG. 4.
Figure 7:
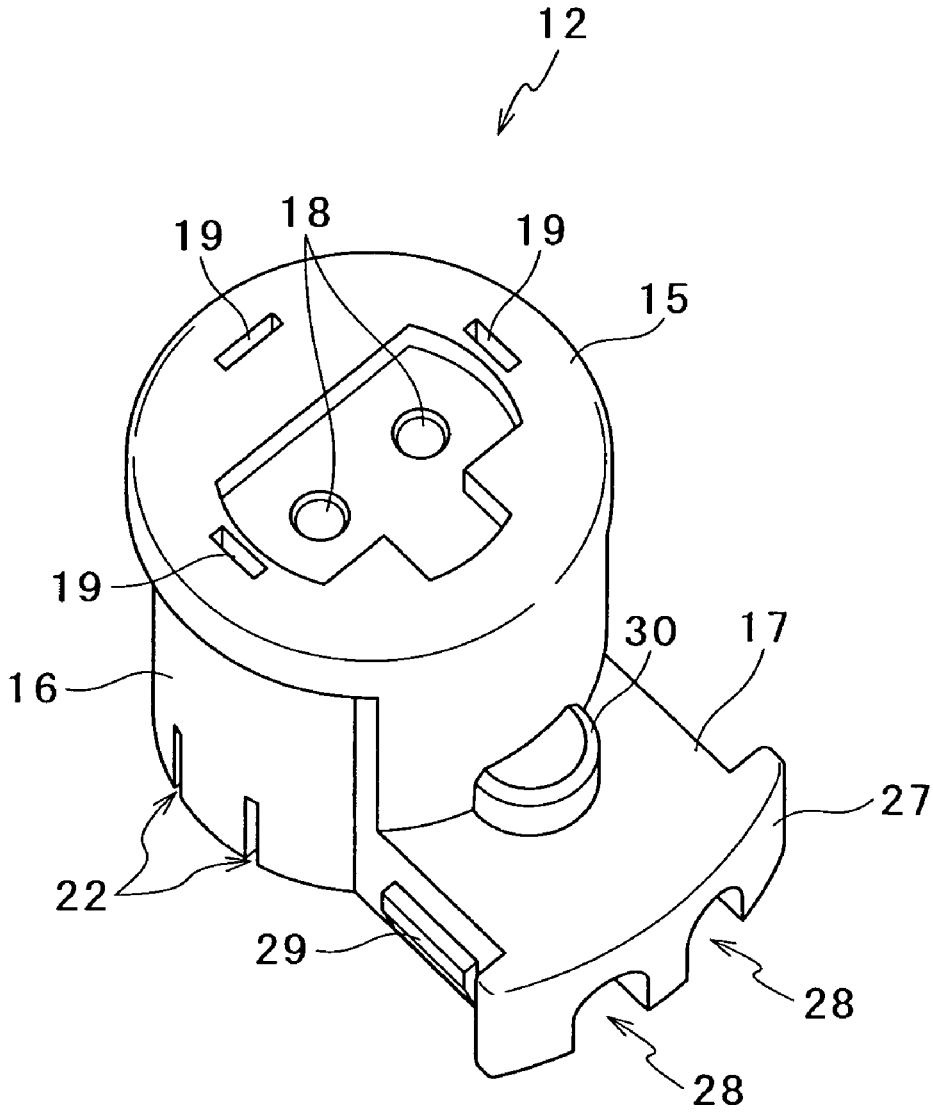
FIG. 7 is a perspective view of the male connector component turned upside down from the state of FIG. 5.

The connector component 12 for connections (hereinafter, referred to as "male connector component 12") is made, for example, of a nonconductive resinous material. The male connector component 12 supports the pair of connecting terminals 11 and 11 and the ferrite member 14 (see FIG. 4), and is fittably inserted into the opening 3 of the female connector component 2. FIG. 6 and FIG. 7 are perspective views of the male connector component 12. FIG. 6 shows the male connector component 12 seen from above, and FIG. 7 shows the male connector component 12 turned upside down from the state of FIG. 6 (i.e., with a bottom thereof up). As shown in FIG. 6 and FIG. 7, the male connector component 12 has a disk-shaped bottom part 15 provided at the lower side thereof, a substantially cylindrical tube part 16 erected from the bottom part 15, and a projection part 17 that vertically protrudes from the upper part of the tube part 16.

A pair of through-holes 18 and 18 are formed in the bottom part 15. The to-be-connected terminals 4 and 4 are passed through the through-holes 18 and 18, respectively, when the electrical connecting device 1 is fitted to the female connector component 2. A plurality of slits 19 are additionally formed in the bottom part 15. The formation of the slits 19 makes it easy to deform the bottom part 15 and to insert the male connector component 12 when the electrical connecting device 1 is fittably inserted into the opening 3.

A container part 20 that holds the pair of connecting terminals 11 and 11 and the ferrite member 14 is formed by an outer peripheral wall 21 in the tube part 16. At the upper part of the outer peripheral wall 21, a pair of slits 22 and 22 are formed at two positions that face each other with the container part 20 placed between the pair of slits 22 and 22 and the pair of slits 22 and 22 in the direction of its long side, whereby two flexible parts 23 are formed. That is, a pair of flexible parts 23 are extended upward so as to form a part of the outer peripheral wall 21. A lock part 24 is provided at the pair of flexible parts 23. The lock part 24 has a tapered part 24*a* that protrudes toward the interior of the container part 20. The tapered part 24*a* is provided at the lower side of the lock part 24, so that the tapered part 24*a* can be engaged with a shoulder 14*c* (see FIG. 5) of the ferrite member 14 that is contained in the container part 20.

A flat surface 31 is formed at a position facing the planar part 14*b* of the ferrite member 14 on the inner periphery of the outer peripheral wall 21. Accordingly, the surface 31 and the planar part 14*b* of the ferrite member 14 can be brought into tight contact with each other, so that the ferrite member 14 can be stably held in the container part 20. A groove 25 is formed upward and downward on the opposite side of the projection part 17 in the outer peripheral wall 21. This groove 25 is fitted to a streak formed on the cover element 13 when the cover element 13 is fitted.

A pair of terminal supporting parts 26 and 26, to which the lead-wire-side ends 11*a* of the pair of connecting terminals 11 and 11 to be inserted are fitted, are formed on the projection part 17. That is, the lead-wire-side ends 11*a* of the pair of connecting terminals 11 and 11 are supported by the terminal supporting part 26, and the connection-side ends 11*b* of the pair of connecting terminals 11 and 11 are supported by the through-holes 14*a* of the ferrite member 14 that is contained in the container part 20. Grooves 28 and 28 used to pass the lead wires 10 and 10 are provided at an end 27 of the projection part 17 contiguously to the terminal supporting parts 26 and 26. Engagement convex parts 29 are formed on the projection part 17 at both sides, respectively, in a width direction (i.e., in a direction in which the pair of terminal supporting parts 26 and 26 are arranged). The engagement convex part 29 is engaged with an engagement concave part formed on the side of the cover element 13 when the cover element 13 is fitted to the male connector component 12.

A semi-cylindrical convex part 30 is formed at a root of the projection part 17 joining with the tube part 16 at the lower side of the projection part 17. The convex part 30 is engaged with the opening 3 of the female connector component 2 in a direction in which the male connector component 12 is rotated while being fittably inserted into the female connector component 2 when the male connector component 12 is fittably inserted into. The male connector component 12 provided with the convex part 30 is fittably inserted into a VDA-LT or VDA-KT type female connector component. As shown in FIG. 13, a semicircular concave part 6 that is engaged with the semi-cylindrical convex part 30 is formed at the edge of the opening 3 of the VDA-LT type female connector component 2. The convex part 30 and the concave part 6 are engaged with each other in the aforementioned rotational direction in a state in which the pair of connecting terminals 11 and 11 are properly connected to the pair of to-be-connected terminals 4 and 4 and in which the electrical connecting device 1 is fitted to the female connector component 2. Therefore, the electrical connecting device 1 can be prevented from being rotated. This rotation preventing mechanism may be formed so as to have an opposite relationship between the convex part and the concave part. That is, the male connector component 12 may have the concave part, and the female connector component may have the convex part.

Figure 8:
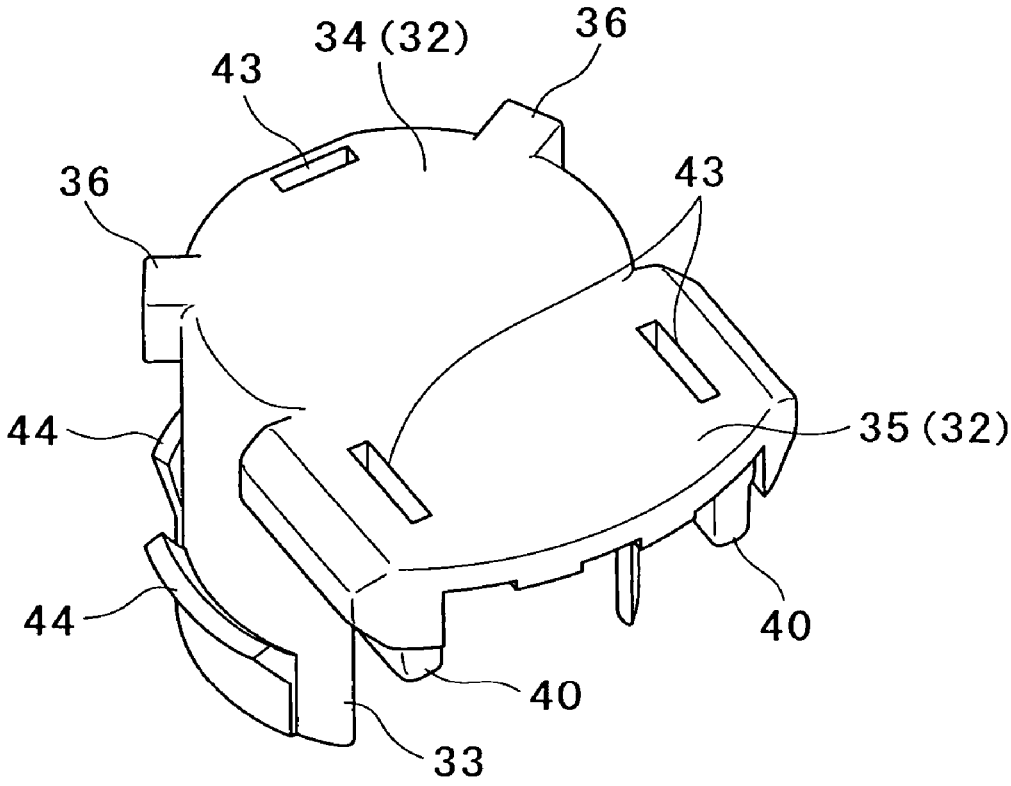
FIG. 8 is a perspective view of a cover element in the electrical connecting device of FIG. 4.
Figure 9:
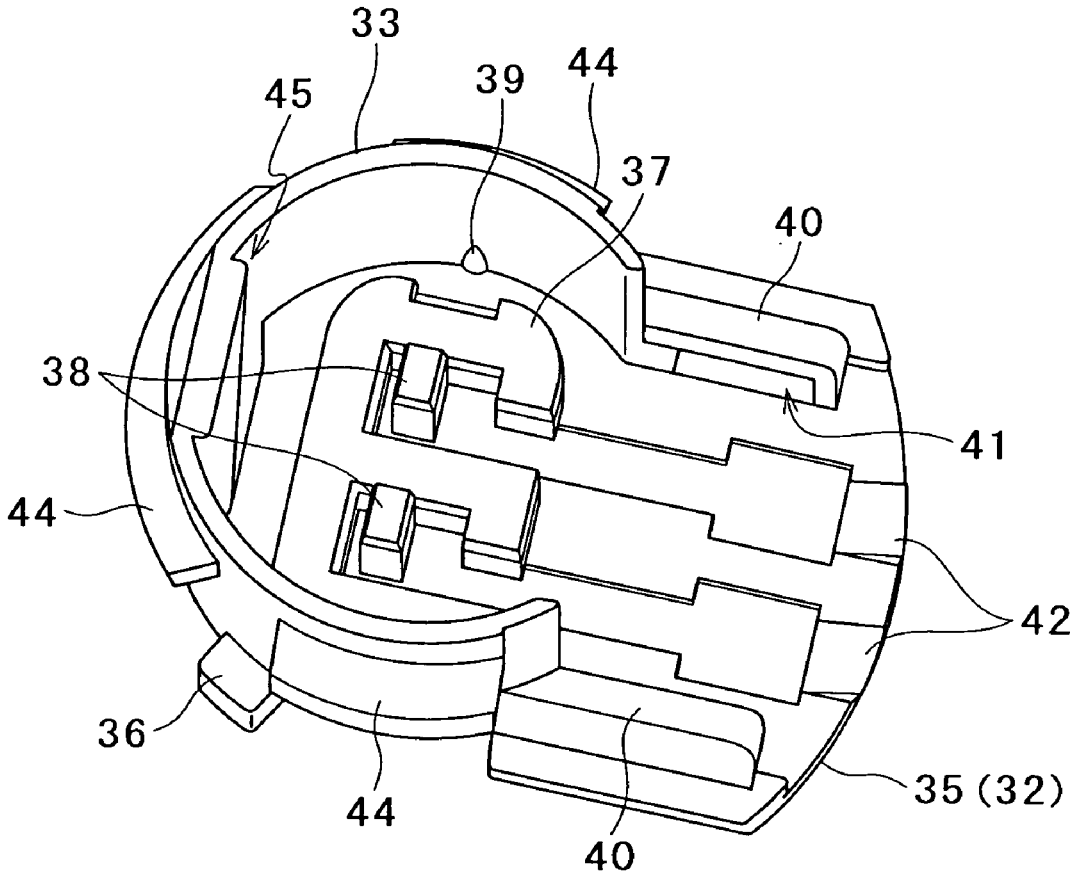
FIG. 9 is a perspective view of the cover element turned upside down from the state of FIG. 8.

The cover element 13 covers an upper opening of the container part 20 (i.e., an opening part at the upper side of the container part 20) into which the connecting terminal 11 and the ferrite member 14 are inserted and an upper opening of the terminal supporting part 26 (an opening part at the upper side of the terminal supporting part 26). The cover element 13 is fitted to the male connector component 12 in such a way as to sandwich the connecting terminal 11 and the ferrite member 14 inserted from the upper opening of the container part 20 between the male connector component 12 and the cover element 13 (see FIG. 4). The cover element 13 is made of, for example, a non-conductive resinous material. FIG. 8 and FIG. 9 are perspective views of the cover element 13. FIG. 8 shows the cover element 13 seen from above, and FIG. 9 shows the cover element 13 turned upside down. As shown in FIG. 8 and FIG. 9, the cover element 13 has a lid 32 that is provided at the upper side and with which the upper opening of the container part 20 and the upper opening of the terminal supporting part 26 are covered and a peripheral wall 33 extended from the lid 32 downward.

The lid 32 is made up of a front lid part 34 with which the upper opening of the container part 20 is covered and a rear lid part 35 with which the upper opening of the terminal supporting part 26 is covered. The front lid part 34 has projections 36 and 36 on both sides, respectively, in the width direction. By providing the projections 36 and 36 on the upper side of the cover element 13 in this way, a check can be easily made as to whether the electrical connecting device 1 and the female connector component 2 have been properly fitted together. In other words, a check can be easily made as to whether these have been properly fitted together by placing a finger onto and applying a force onto the projection 36 formed on the upper side of the cover element 13 when the cover element 13 and the male connector component 12 are fittably inserted into the opening 3 so as to connect the electrical connecting device 1 to the female connector component 2.

A ferrite pressing part 37 and a pair of terminal pressing parts 38 and 38 are formed on an undersurface of the front lid part 34. The ferrite pressing part 37 is provided at a position that faces the upper part of the ferrite member 14 contained in the container part 20 so as to restrict upward and downward movements of the ferrite member 14 in a state in which the cover element 13 is fitted to the male connector component 12. The pair of terminal pressing parts 38 and 38 are provided at positions that face the upper part of the connection-side end 11*b* of the pair of connecting terminals 11 and 11 so as to restrict upward and downward movements of the connecting terminal 11.

Projection parts 40 and 40 that protrude from both sides in the width direction downward are formed on the rear lid part 35. The projection part 40 has an engagement concave part 41 that is engaged with the engagement convex part 29 formed on both sides in the width direction of the projection part 17 of the male connector component 12. That is, the cover element 13 is fitted to the male connector component 12 by engaging the engagement convex part 29 with the engagement concave part 41.

A lead wire pressing part 42 is projectively formed on a part corresponding to the groove 28 of the male connector component 12 in the rear lid part 35. The lid 32 has a plurality of slits 43. The formation of these slits 43 makes it easy to deform the lid 32 and to fittably insert the cover element 13 when the electrical connecting device 1 is fittably inserted into the opening 3.

As shown in FIG. 3, the rear lid part 35 of the cover element 13 and the projection part 17 of the male connector component 12 are made short so that the rear lid part 35 and the projection part 17 can be housed within the outer diameter of the female connector component 2 when viewed planarly. As a result, it becomes possible to avoid resistance applied by a blast occurring when the air bag is inflated.

In FIG. 8 and FIG. 9, the peripheral wall 33 is extended from the front lid part 34 downward in such a way as to cover the outer peripheral wall 21 of the male connector component 12. Therefore, the flexible part 23 forming a part of the outer peripheral wall 21 is regulated from bending in an expanding direction outward by fitting the cover element 13 to the male connector component 12. Thus, the lock part 24 is regulated from moving in a direction in which the engagement between the lock part 24 that is formed on the flexible part 23 and that protrudes toward the inside of the container part 20 and the shoulder 14*c* of the ferrite member 14 is released (i.e., in a direction in which the flexible part 23 expands outward). That is, the peripheral wall 33 forms a regulating part that regulates the movement of the lock part 24 in the cover element 13.

The regulating part formed by the peripheral wall 33 has a convex part (rib) 39 that presses the lock part 24 in a direction in which the lock part 24 is engaged with the shoulder 14*c* of the ferrite member 14 when the cover element 13 is fitted to the male connector component 12. The convex part 39 is provided at the joint between the peripheral wall 33 and the rear lid part 35 inside the peripheral wall 33. The convex part 39 is provided on both sides in the width direction, and is brought into contact with the flexible part 23 provided on both sides in the width direction of the male connector component 12 when the cover element 13 is fitted. In other words, when the convex part 39 comes in contact with the flexible part 23, the lock part 24 is pressed in the direction in which the lock part 24 is engaged with the shoulder 14*c* of the ferrite member 14.

A projection 44 that protrudes outward is formed on the outer periphery of the peripheral wall 33. The projection 44 is engaged with the concave part 5 provided at the opening 3 when the cover element 13 is fittably inserted into the opening 3 together with the male connector component 12 (see FIG. 13). The projection 44 is disposed along the periphery of the peripheral wall 33, and is contiguously formed at three places, i.e., at both sides in the width direction and a front side of the cover element 13. The projection 44 is formed in such a way as to expand toward the upper part of the cover element 13.

A streak 45 extended in upward and downward directions is formed on the front of the inner part of the peripheral wall 33. The streak 45 is slid into and fitted to the groove 25 formed on the outer peripheral wall 21 of the tube part 16 of the male connector component 12 when the cover element 13 is fitted to the male connector component 12.

Figure 10:
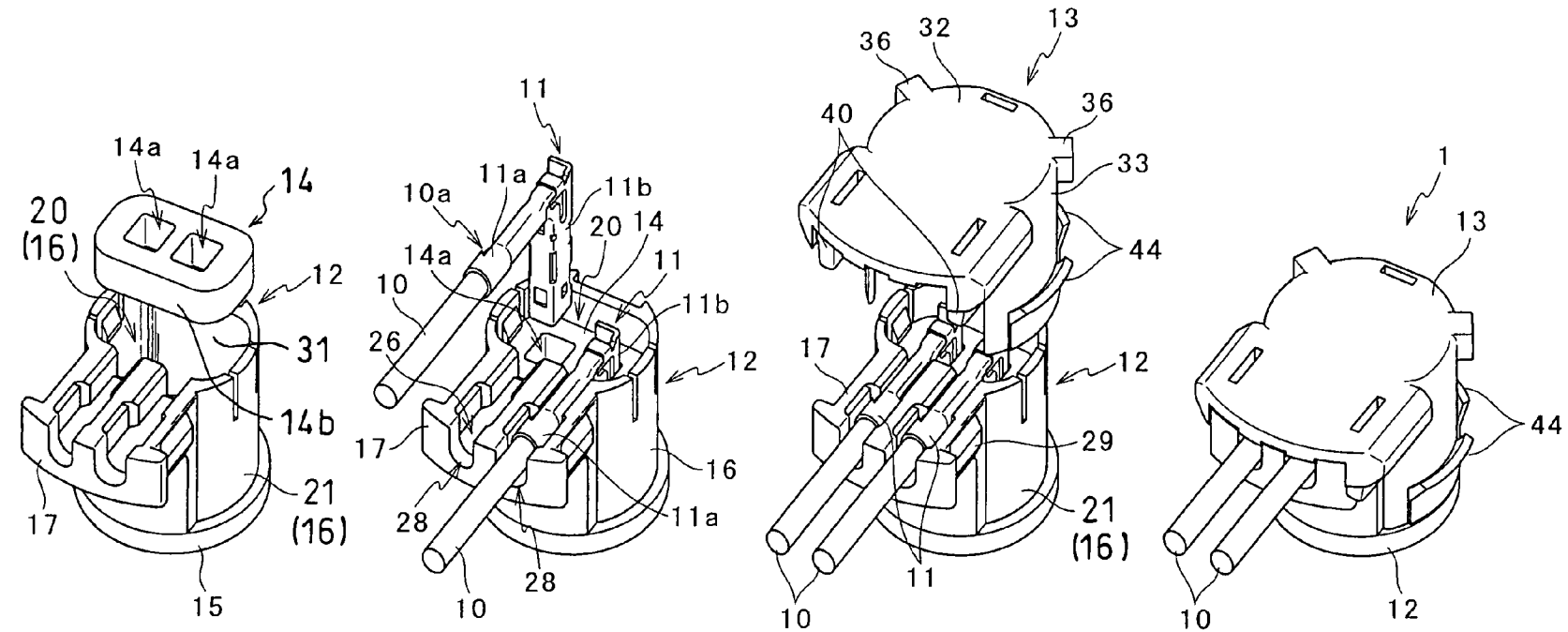
FIG. 10 is a perspective view for explaining an assembly process of the electrical connecting device of FIG. 1.

FIG. 10 is a perspective view explaining steps for assembling the electrical connecting device 1 from the aforementioned constituent parts. First, the ferrite member 14 is inserted into the container part 20 of the tube part 16 in the male connector component 12 as shown in FIG. 10 (*a*). The ferrite member 14 inserted into the container part 20 is supported by the male connector component 12. The ferrite member 14 is inserted into the container part 20 in such a way that the planar parts 14*b* and 14*b* slide on the surfaces 31 and 31 (only one of which is shown) planarly formed on the inner periphery of the outer peripheral wall 21, and is held stably in the forward and backward directions (i.e., a direction in which the planar part 14*b* and the surface 31 face each other) in the container part 20.

After the ferrite member 14 is supported in the male connector component 12, the pair of connecting terminals 11 in which the lead-wire-side end 11*a* is pressed against the naked end part 10*a* of the lead wire 10 are inserted from the upper opening of the container part 20 and the upper opening of the terminal supporting part 26 as shown in FIG. 10 (*b*). At this time, the lead-wire-side end 11*a* of the connecting terminal 11 is contained and supported in the terminal supporting part 26 in such a way as to be fitted thereto. The connection-side end 11*b* of the connecting terminal 11 is then inserted into and supported in the through-hole 14*a* formed in the ferrite member 14.

After the pair of connecting terminals 11 are inserted, the cover element 13 is fitted to the upper parts of the male connector component 12 and is fitted to the male connector component 12 as shown in FIG. 10 (*c*). When the cover element 13 is fitted, the peripheral wall 33 of the cover element 13 covers the outer peripheral wall 21 of the tube part 16 of the male connector component 12, and the streak 45 of the cover element 13 is fitted to the groove 25 of the male connector component 12 while sliding into the groove 25. The concave part 41 of the projection part 40 formed on both sides in the width direction of the cover element 13 is then engaged with the convex part 29 formed on both sides in the width direction of the projection part 17 of the male connector component 12, whereby the engagement between the cover element 13 and the male connector component 12 is completed. Thus, an assembly of the electrical connecting device 1 shown in FIG. 10 (*d*) is obtained.

Figure 11:
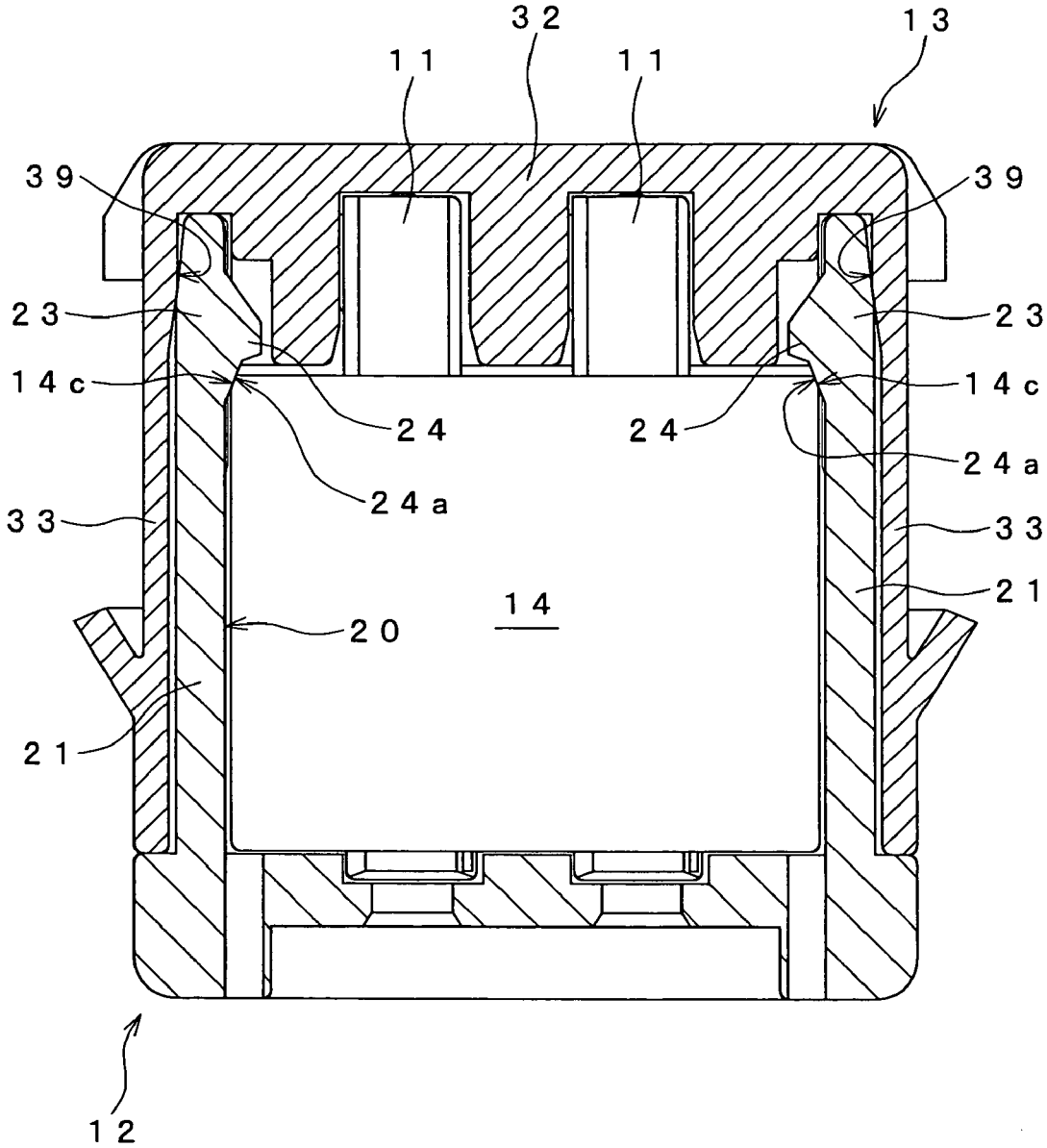
FIG. 11 is a sectional view in the width direction of the electrical connecting device of FIG. 1.

FIG. 11 is a sectional view in the width direction of the electrical connecting device 1 that has been assembled, and shows a contained state of the ferrite member 14. The ferrite member 14 contained in the container part 20 of the male connector component 12 has both shoulders 14*c* engaged with the lock parts 24 formed on the flexible parts 23 at the upper part of the outer peripheral wall 21. That is, the shoulder 14*c* is engaged with the tapered part 24*a* of the lock part 24 that protrudes toward the inside of the container part 20. The movement of the lock part 24 in a direction in which the engagement between the lock part 24 and the shoulder 14*c* is released is regulated by the peripheral wall (regulating part) 33 of the fitted cover element 13. Therefore, even if the ferrite member 14 varies in size, the shoulder 14*c* is held while being pressed into the container part 20 by the tapered part 24*a*, so that a variation in size can be absorbed.

The convex part 39 formed on the peripheral wall 33 of the cover element 13 presses the lock part 24 in a direction in which the lock part 24 is engaged with the shoulder 14*c*. Therefore, the lock part 24 can be urged by the convex part 39 while allowing the lock part 24 to be in contact with the shoulder 14*c*, and the ferrite member 14 can be reliably prevented from jouncing in the container part 20.

Figure 12:
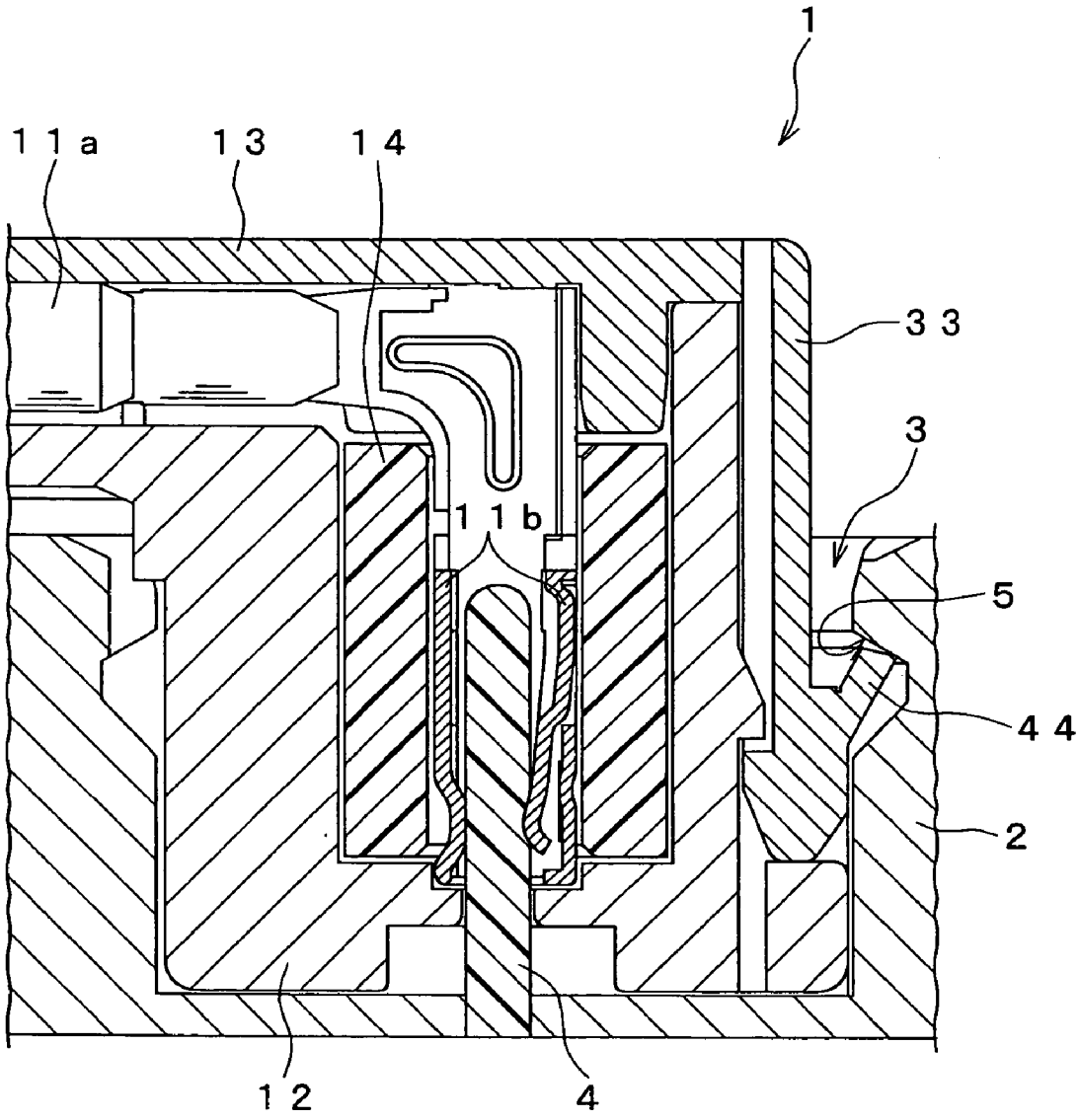
FIG. 12 is a longitudinal sectional view showing a state in which the electrical connecting device of FIG. 1 has been connected to the female connector component.

FIG. 12 is a longitudinal sectional view showing a state in which the electrical connecting device 1 is connected to the female connector component 2, and is a sectional view in a plane parallel to the connecting terminal 11. The assembled electrical connecting device 1 is fittably inserted into the opening 3 of the female connector component 2. At this time, the convex part 44 comes into contact with the edge of the opening 3, and is temporarily bent inward. The opening 3 has the concave part 5 in the circumferential direction. When the electrical connecting device 1 is fittably inserted deeply into the opening 3, the temporarily bent convex part 44 is moved to the concave part 5, and is engaged with the concave part 5 by the recovery of elasticity. Thereby, a mechanical connection (engagement) between the electrical connecting device 1 and the female connector component 2 is completed. When the engagement therebetween is completed, the pair of to-be-connected terminals 4 on the side of the female connector component 2 are inserted into the connection-side ends 11*b* of the pair of connecting terminals 11 on the side of the electrical connecting device 1, and are brought into contact with the connection-side ends 11*b*, respectively, so as to reach a state in which an electric current can be applied to the squib (i.e., reach an electrically connected state).

According to the electrical connecting device 1 described above, the lock part 24 of the male connector component 12 is engaged with the shoulder 14*c* of the ferrite member 14 at the tapered part 24*a* thereof, and the movement of the lock part 24 in the direction in which the engagement between the lock part 24 and the shoulder 14*c* is released is regulated by being fitted to the cover element 13. Therefore, even if the ferrite member 14 varies in size, the shoulder 14*c* is held while being pressed into the container part 20 by means of the tapered part 24*a*, so that a variation in size can be absorbed. That is, the ferrite member 14 is prevented from becoming shaky or unstable, and can be stably held in the container part 20. Therefore, the noise removing performance can be prevented from being lowered by a shaky movement even if the ferrite member varies in size. Additionally, the lock part 24 can be urged in a direction in which it is engaged with the shoulder 14*c* by means of the convex part 39 formed on the regulating part 33, and the ferrite member 14 can be reliably prevented from becoming shaky in the container part 20. Additionally, since the lock part 24 is provided on the flexible part 23 that is a part of the outer peripheral wall 21, it is possible to easily form the lock part 24 which is engaged with the shoulder 14*c* while being pressed against the shoulder 14*c* by being fitted to the cover element 13. Still additionally, the flexible part 23 can be easily formed only by providing the slit 22 in the peripheral wall 33, and its flexibility can be easily adjusted by changing the depth of the slit (i.e., by changing the length of the slit in the upward and downward directions). Still additionally, since the ferrite member 14 has the planar part 14*b*, the surface 31 planarly formed on the inner periphery of the outer peripheral wall 21 and the planar part 14*b* can be brought into tight contact with each other, and the ferrite member 14 can be stably held in the container part 20.

Although the present invention has been described with respect to preferred embodiments, it is intended that alternatives, modifications, and equivalents within the scope of the appended Claims, from which these will be clarified by reading and understanding this description as a matter of course, are all included in the scope of the present invention.

For example, the present invention can be embodied to have the following changes.

The electrical connecting device may be structured such that the convex part that presses the lock part in a direction in which the lock part is engaged with the shoulder of the ferrite member is not provided on the peripheral wall that serves as a regulating part. In this case, preferably, a gap between the outer peripheral wall of the male connector component and the peripheral wall of the cover element is set to be small. The position and the shape of the convex part can be variously changed without being limited to those described in the aforementioned embodiments.

Further, it is permissible that the outer peripheral wall of the male connector component does not have the flexible part extended upward so as to form a part thereof. The position and the shape of the flexible part can be variously changed without being limited to those described in the aforementioned embodiment.

Further, it is permissible that the ferrite member does not have a part planarly formed on the peripheral side face. In this case, preferably, a gap between the inner periphery of the container part and the peripheral side face of the ferrite member is set to be small.

INDUSTRIAL APPLICABILITY

As is apparent from the foregoing description, the electrical connecting device of the present invention is suitable to be applied as an electrical connecting device especially for a squib that is ignited by applying an electric current to a gas generator in an air bag system for vehicles. However, the electrical connecting device can be extensively applied, and can be applied in many different environments and for various objects.

What is claimed is:

1. An electrical connecting device that is connected to a female connector component supporting a pair of to-be-connected terminals, comprising:

a ferrite member having a pair of through-holes through which a pair of connecting terminals that are electrically connected to the pair of to-be-connected terminals are respectively passed;

a male connector component having a container part that holds the pair of connecting terminals and the ferrite member and a lock part having a tapered part protruding toward the inside of the container part, the tapered part being engaged with a shoulder of the ferrite member contained in the container part, and that is fittably inserted into an opening formed in the female connector component; and a cover element that is fitted to the male connector component in such a way as to sandwich the connecting terminals and the ferrite member between the cover element and the male connector component while covering an upper opening of the container part into which the connecting terminals and the ferrite member are inserted, the cover element regulating a movement of the lock part in a direction in which an engagement between the lock part and the shoulder is released.

2. The electrical connecting device of claim 1, wherein a regulating part that regulates the movement of the lock part in the cover element has a convex part that presses the lock part in a direction in which the lock part is engaged with the shoulder when the cover element is fitted to the male connector component.

3. The electrical connecting device of claim 1, wherein the lock part is provided on a flexible part extended upward so as to form a part of an outer peripheral wall that constitutes the container part in the male connector component.

4. The electrical connecting device of claim 1, wherein the ferrite member has a part planarly formed on a peripheral side face.

* * * * *